US010527386B2

(12) United States Patent
Faxon

(10) Patent No.: US 10,527,386 B2
(45) Date of Patent: Jan. 7, 2020

(54) FIREARM HANDGUARD AND ATTACHMENT ASSEMBLY

(71) Applicant: Faxon Firearms, LLC, Cincinnati, OH (US)

(72) Inventor: Robert T. Faxon, Cincinnati, OH (US)

(73) Assignee: Faxon Firearms, LLC, Cincinnati, OH (US)

( * ) Notice: Subject to any disclaimer, the term of this patent is extended or adjusted under 35 U.S.C. 154(b) by 0 days.

(21) Appl. No.: 15/861,723

(22) Filed: Jan. 4, 2018

(65) Prior Publication Data

US 2018/0195832 A1 Jul. 12, 2018

Related U.S. Application Data

(60) Provisional application No. 62/444,842, filed on Jan. 11, 2017.

(51) Int. Cl.
*F41C 23/16* (2006.01)
*F41A 21/48* (2006.01)

(52) U.S. Cl.
CPC ..... *F41C 23/16* (2013.01); *F41A 21/482* (2013.01)

(58) Field of Classification Search
CPC ..... F41C 23/16; F41C 27/00; F41A 21/482
See application file for complete search history.

(56) References Cited

U.S. PATENT DOCUMENTS 8,448,553 B2 5/2013 Zhang
8,607,490 B1 * 12/2013 Zinsner ..... F41C 23/16 42/71.01
8,863,426 B1 * 10/2014 Zinsner ..... F41C 23/16 42/71.01
9,157,697 B2 * 10/2015 Leclair ..... F41C 23/16
9,857,138 B2 * 1/2018 Geissele ..... F41A 21/48
9,909,836 B2 * 3/2018 Galletta, II ..... F41C 23/16
2011/0126443 A1 * 6/2011 Sirois ..... F41C 23/16 42/90
2012/0042557 A1 * 2/2012 Gomez ..... F41C 23/16 42/90
2012/0180358 A1 * 7/2012 Samson ..... F41A 13/12 42/71.01

(Continued)

*Primary Examiner* — Benjamin P Lee

(74) *Attorney, Agent, or Firm* — Wood Herron & Evans LLP

(57) ABSTRACT

Provided is a handguard attachment mechanism for use with a firearm using a standard AR-pattern barrel nut having a substantially cylindrical portion with an axial length and an enlarged diameter radial flange at a forward end. The handguard includes a substantially tubular handguard with proximal and distal ends. The proximal end includes a longitudinal slot extending from the proximal end toward, but not to, the distal end. A pair of clamping lugs, one positioned on each side of the slot adjacent the proximal end, have means for adjustably drawing the clamping lugs together to narrow at least a portion of the longitudinal slot. A circumferentially incomplete barrel nut bushing is configured to fit on the barrel nut. When the barrel nut bushing is placed on the barrel nut and the proximal end of the handguard is placed over the barrel nut bushing, the clamping means adjustably draws the clamping lugs together, compressing the barrel nut bushing on the barrel nut, to releasably secure the handguard to the barrel nut.

3 Claims, 6 Drawing Sheets

(56) References Cited

U.S. PATENT DOCUMENTS

| | | | | |
|---|---|---|---|---|
| 2014/0026459 | A1* | 1/2014 | Yan | F41C 23/16 42/71.01 |
| 2016/0054096 | A1* | 2/2016 | Dzwill | F41C 23/16 42/75.02 |
| 2017/0097207 | A1* | 4/2017 | Hines | F41C 23/16 |
| 2018/0058807 | A1* | 3/2018 | Cheng | F41A 5/26 |

* cited by examiner

FIREARM HANDGUARD AND ATTACHMENT ASSEMBLY

TECHNICAL FIELD

The present invention relates to a barrel shroud or handguard for a firearm to protect the user's hands from a hot barrel and to provide a means for mounting accessories to the forearm of the rifle. More particularity, it provides an attachment mechanism that utilizes an ordinary and standard barrel nut and upper receiver.

BACKGROUND

In order to be considered to have a "free floating" barrel, a rifle handguard must attach only at its proximal end and cannot be attached to the barrel at a distal point. Some prior handguards that accommodate a free floating barrel have attached the proximal end to the upper receiver. These require a specialized upper receiver to be paired with the handguard. Other handguards have integrated a specialized barrel nut, which can be used with an ordinary and standard upper receiver, but require a nonstandard barrel nut. In these, when removal of the handguard requires removal of the barrel nut, the barrel is also released.

SUMMARY OF THE INVENTION

The present invention allows removal and reassembly of the handguard to the upper receiver without removal of the barrel nut and/or barrel. Moreover, it utilizes a standard and ordinary (mil-spec) barrel nut and upper receiver without requiring the replacement of these parts with specialized parts.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWING FIGURES

Like reference numerals are used to indicate like parts throughout the various drawing figures, wherein.

DETAILED DESCRIPTION

Figure 1:
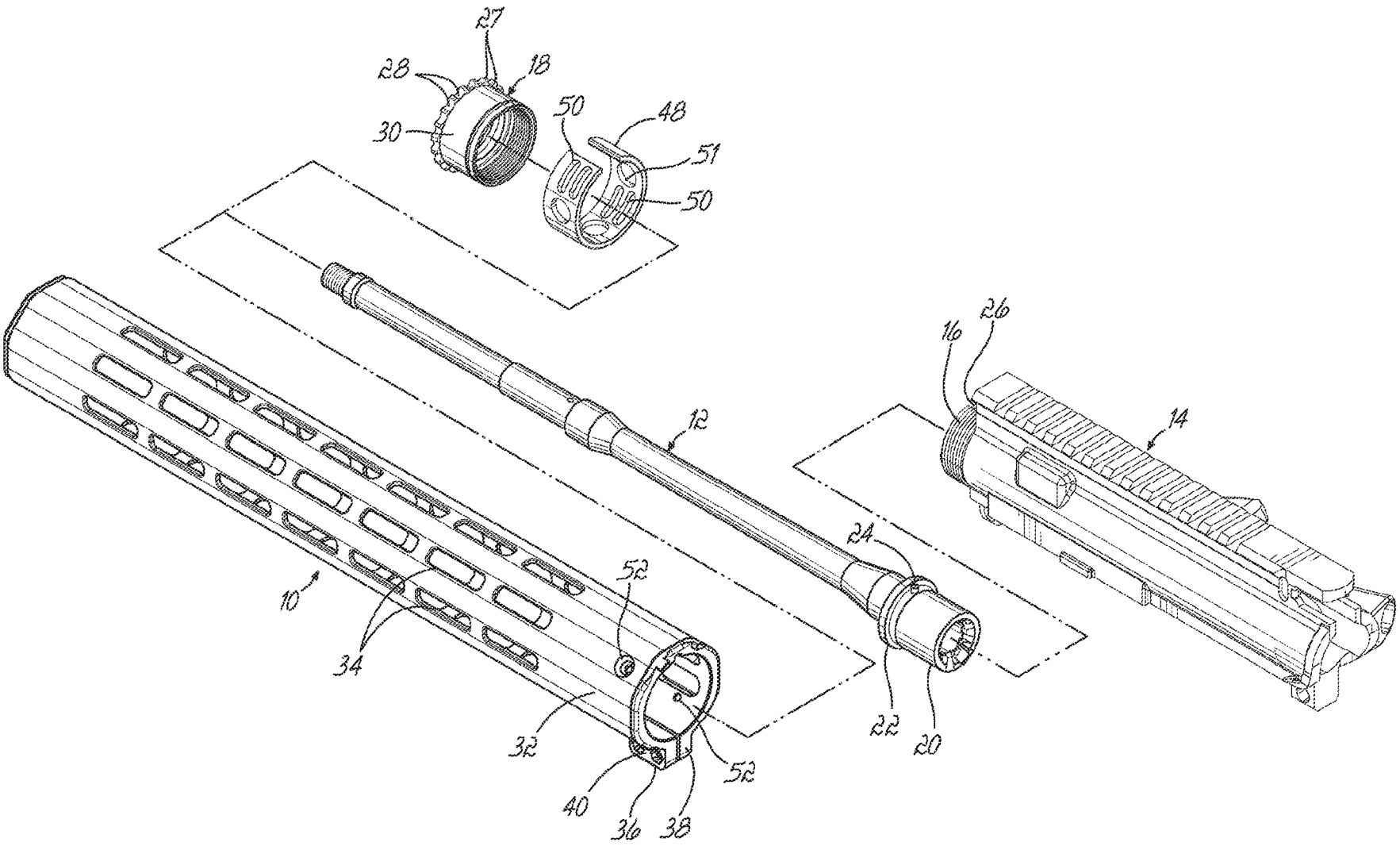
FIG. 1 is an exploded isometric view of an AR-pattern upper receiver, barrel, and hand guard attachment assembly according to an embodiment of the present invention.
Figure 2:
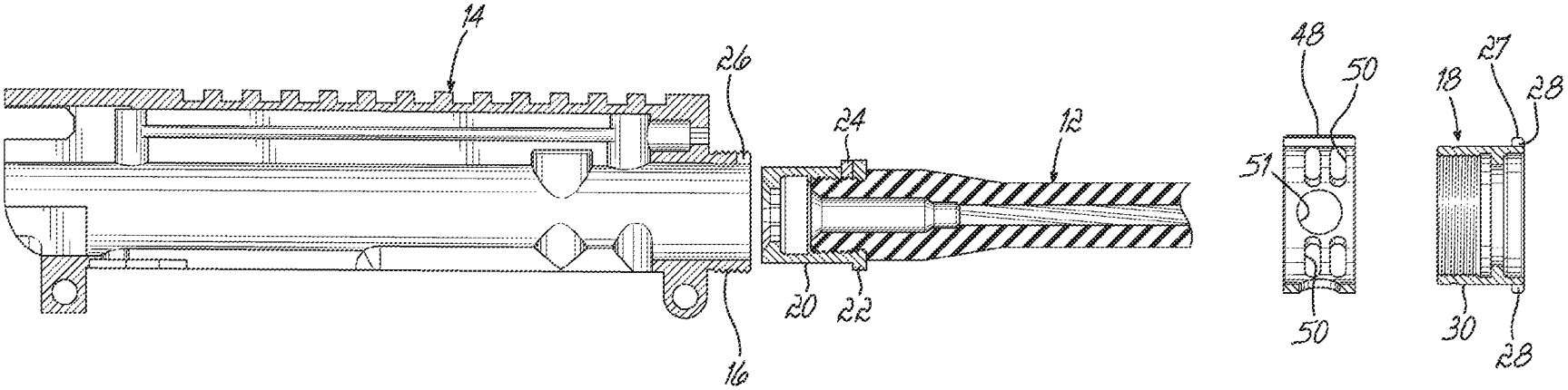
FIG. 2 is an exploded side sectional view showing the upper receiver, partial barrel, barrel nut bushing, and barrel nut.
Figure 3:
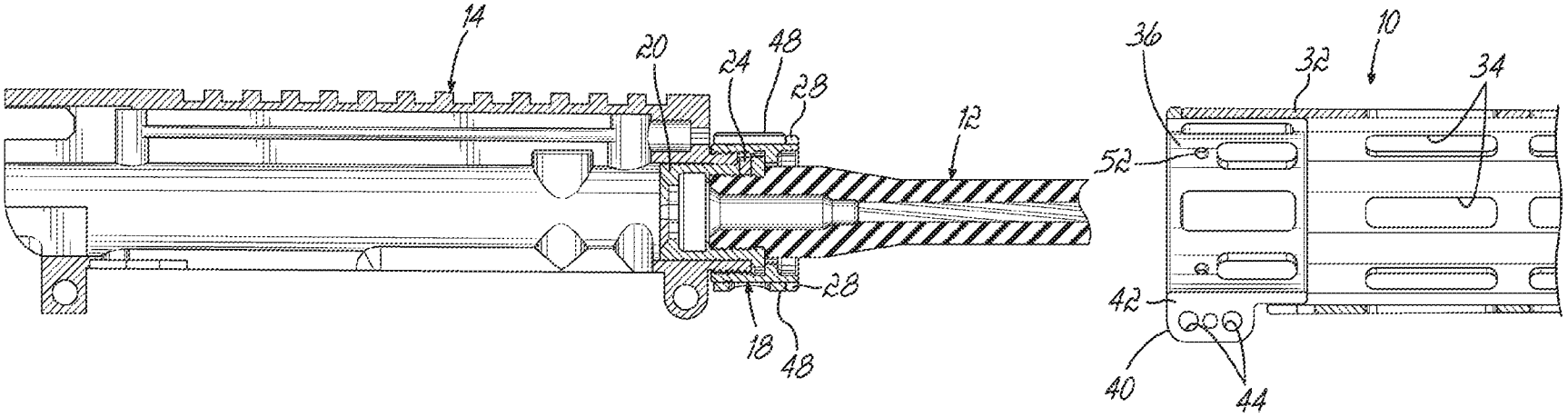
FIG. 3 is a similar side sectional view showing the upper receiver, partial barrel, barrel nut, and barrel nut bushing assembled, with a detached hand guard partially shown.
Figure 4:
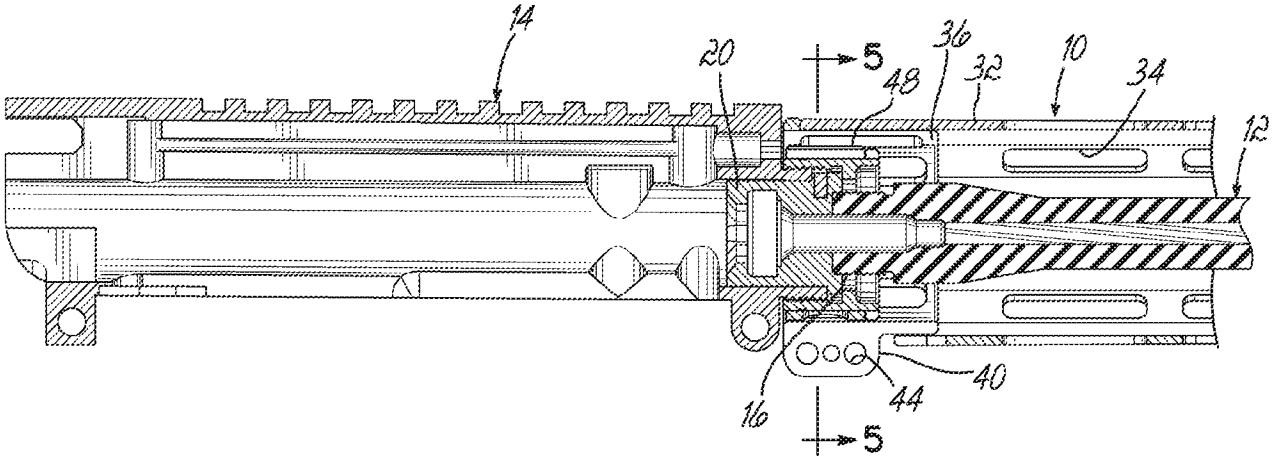
FIG. 4 is a view similar to FIG. 3 showing the handguard assembled to the upper receiver.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Referring first to FIG. 1, the present invention provides a hand guard 10 that may be mounted over a barrel 12 to an upper receiver 14 having an ordinary and standard threaded connection 16, as well as an ordinary and standard barrel nut 18. In an AR-pattern firearm, the barrel 12 with an attached barrel extension 20 is secured to the treaded connection 16 of the upper receiver 14 using the barrel nut 18. As used herein, an "AR-pattern" firearm includes those patterned after the AR15, AR10, M16, M4, and functional clones thereof, whether in a rifle or pistol configuration. The barrel nut 18 engages an annular flange 22 against a forward face of the threaded connection 16 to secure the barrel 12 to the upper receiver 14. Typically, the barrel extension 20 includes an alignment pin 24 that engages a notch 26 on the treaded connection 16 to assure rotational alignment.

Others have used a variety of means for attaching a handguard to an upper receiver while maintaining a "free float" barrel. These include attachment mechanisms that require a specialized upper receiver and/or a specialized barrel nut. One benefit of the present invention is that it can be used with an ordinary and common upper receiver 14 and barrel nut 18, and allows the handguard to be removed without removing or loosening the barrel nut 18.

An ordinary and common barrel nut 18 includes a radial flange 27 at its forward edge with a circumferential series of notches 28 and a smaller diameter cylindrical body portion 30. The notches 28 allow engagement of a standardized barrel nut spanner wrench, as well as clearance for a gas tube or operating rod (not shown). As used herein, a "standard" AR-pattern barrel nut 18 is one made substantially according to standard U.S. Army specifications (Mil-Spec) having an outer cylindrical body portion 30 surface (exclusive of the radial flange 27) 1.367 inches (−0.007) in diameter and at least 0.73 inch in axial length. These specifications are set forth by the U.S. Department of the Army, Rock Island Arsenal, for National Stock Number (NSN) 1005-00-978-1034, Part No. 8448553, CAGE 19204.

The tubular body 32 of the hand guard 10 can be of any suitable cross-sectional shape, any suitable length (relative to the length of the barrel and any muzzle device), and made of any suitable material. Whether the tubular body 32 is round or polygonal (as shown), its diameter is generally determined by that necessary to clear a gas block (not shown) mounted on the barrel 12 and/or a gas tube or operating rod (not shown). The length of the tubular body portion body 32 generally is determined by the length of the barrel 12 (and any muzzle device). If desired, the tubular body 32 may be solid or include a series of openings 34 that provide ventilation around the barrel 12 and/or may facilitate attachment of accessories or accessory-mounting rails. The tubular body 32 may be extruded from metal, such as aluminum, or formed of a composite material (such as carbon fiber and resin), for example.

According to one aspect of the present invention, the proximal end of the handguard 10 may include a clamping adaptor 36 secured onto or integrated into the open end of the tubular body 32. As shown in the illustrated embodiment, the clamping adaptor 36 may include a pair of clamping lugs 38, 40 situated on opposite sides of a longitudinal split 42 that extends a limited distance along the tubular body 32. The clamping lugs 38, 40 may include one or more sockets or openings 44 adapted to receive a threaded fastener 46 and/or nuts (not shown) to draw together the clamping lugs 38, 40 and longitudinal split 42 when tightened.

According to another aspect of the present invention, the illustrated embodiment includes a barrel nut bushing 48 in the form of an incomplete circle having an inside diameter sized to closely fit onto the cylindrical body portion 30 of the barrel nut 18. Likewise, the barrel nut bushing 48 may have a length substantially matching that of the cylindrical body portion 30 of the barrel nut 18 and an outside diameter similar to that of the radial flange 27.

When the barrel nut bushing 48 is placed on the cylindrical body portion 30 of the barrel nut 18, it does not interfere with the normal assembly or attachment of the barrel 12 to the upper receiver 14. Because the barrel nut bushing 48 is circumferentially incomplete (i.e., an incomplete circle), it can have a spring-friction fit that allows it to be rotationally orientated after the barrel nut 18 has been firmly threaded onto the threaded connection 16 of the upper receiver 14, but also allows it to be circumferentially compressed to be clamped tightly on the barrel nut 18. The barrel nut flange 27 prevents the barrel nut bushing 48 from slipping longitudinally forward. The barrel nut bushing 48 has an outer diameter of at least that of the radial flange 27. For a mil-spec barrel nut 18, this is 1.560 inches (+/− 0.005).

In order to slide the hand guard 10 longitudinally into place, the clamping adaptor 36 has an inside diameter adequate to closely pass over the radial flange 27 of the barrel nut 18 and barrel nut bushing 48. The thickness of the barrel nut bushing 48, as described above, is such that it provides a close fit engagement with the inside of the clamping adaptor 36. As described above, tightening of the threaded fastener 46 in the clamping lugs 38, 40 reduces the gap provided by the longitudinal split 42. This provides circumferential compression against the barrel nut bushing 48, which as an incomplete circle allows the handguard 10 to be firmly secured to the barrel nut 18 by compression. In addition to the clamping securement, as described above, the barrel nut flange 27 prevents longitudinal displacement of the barrel nut bushing 48.

Figure 5:
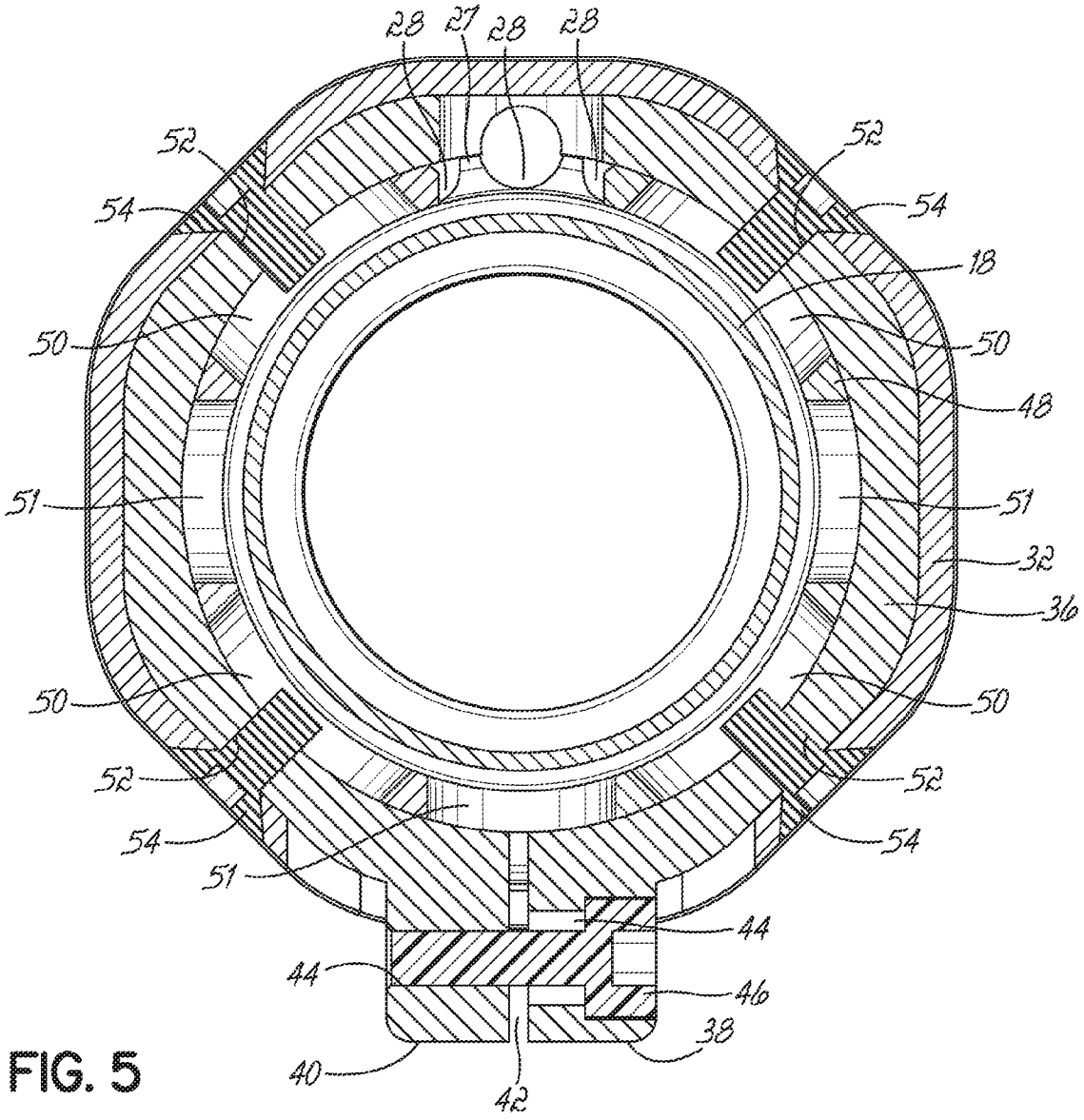
FIG. 5 is a cross-sectional view taken substantially along line 5-5 of FIG. 4.
Figure 6:
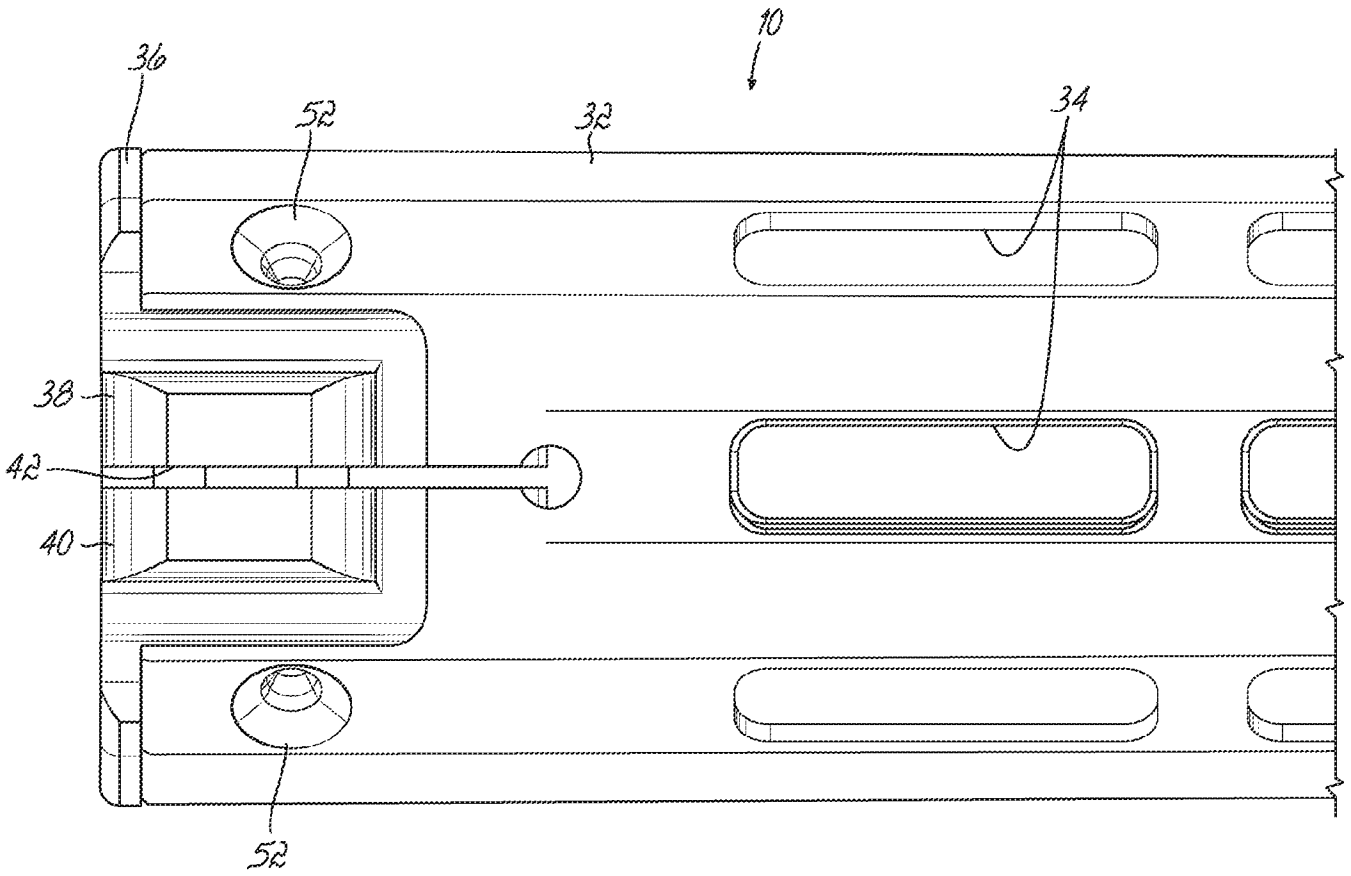
FIG. 6 is a partial bottom plan view of a proximal end of the handguard.

According to another feature of the illustrated embodiment, the present invention may include an additional securement means, particularly for further preventing longitudinal displacement of the handguard 10. The barrel nut bushing 48 may be provided with one or more series of circumferentially spaced engagement openings 50. There may be two to eight openings 50 in each circumferential series which may be evenly spaced around the barrel nut bushing 48 and/or maybe circumferentially elongated (as shown). The bushing 48 may include other cut-outs 51, if desired to reduce weight or increase circumferential flexibility. The handguard 10 may be provided with one or more corresponding circumferentially spaced series of fastener openings 52 at its proximal end. As shown in FIG. 5, these fastener openings 52 may provide threaded sockets to receive threaded fasteners 54 that extend through the tubular body 32 and/or clamping adaptor 36, the ends of which are received by respective engagement openings 50 of the barrel nut bushing 48. Thus, the threaded engagement fasteners 54 need not or should not bear against the cylindrical body portion 30 of the barrel nut 18. Instead, they may extend only far enough to provide a mechanical interlock with the engagement openings 50 of the barrel nut bushing 48 after the proximal end of the handguard 10 has been firmly clamped to the barrel nut bushing 48 and barrel nut 18. The barren nut bushing 48 may be two or more axially spaced series of openings 50 to allow a greater number of threaded engagement fasteners 54 to be used or to allow selective axial mounting positions of the handguard 10.

Accordingly, unlike other handguard attachment mechanisms that integrate a barrel nut into the handguard or require a specialized barrel nut, the present invention provides a secure attachment while allowing removal and reassembly of the handguard 10 to the upper receiver 14 without removal of the barrel nut 18 and/or barrel 12 while employing the common, standard mil-spec barrel nut 18.

While one embodiment of the present invention has been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What I claim is:

1. A handguard attachment mechanism for use with a firearm using a standard AR-pattern barrel nut having a substantially cylindrical portion with an axial length and an enlarged diameter radial flange at a forward end, comprising:

a substantially tubular handguard having proximal and distal ends, the proximal end including a longitudinal slot extending from the proximal end toward, but not to, the distal end;

a pair of clamping lugs, one positioned on each side of the slot adjacent the proximal end, the clamping lugs having means for adjustably drawing the clamping lugs together to narrow at least a portion of the longitudinal slot;

a circumferentially incomplete barrel nut bushing configured to fit on the substantially cylindrical portion of the barrel nut, the bushing having an axial length no greater than the axial length of the substantially cylindrical portion and an outer diameter at least that of the radial flange of the barrel nut;

wherein when the barrel nut bushing is placed on the substantially cylindrical portion of the barrel nut and the proximal end of the handguard is placed over the barrel nut bushing, the clamping means adjustably draws the clamping lugs together, compressing the barrel nut bushing on the barrel nut, to releasably secure the handguard to the barrel nut, and wherein the barrel nut bushing includes a series of circumferentially spaced unthreaded openings and the handguard proximal end includes a corresponding series of threaded fastener openings with a threaded fastener removably threaded into each handguard threaded fastener opening to extend into the corresponding unthreaded barrel nut bushing opening.

2. The handguard attachment mechanism of claim 1, wherein the clamping lugs include threaded openings and the means for adjustably drawing the clamping lugs together include threaded fasteners.

3. The handguard attachment mechanism of claim 1, wherein the handguard includes a tube made of composite material and a clamping adapter made of a metal material, the clamping lugs being part of the clamping adapter.

* * * * *